US005152398A

United States Patent [19]

Forestal et al.

[11] Patent Number: 5,152,398

[45] Date of Patent: Oct. 6, 1992

[54] CONVENIENCE TRAY

[76] Inventors: Robert J. Forestal, 2714 Coldstream La., Indianapolis, Ind. 46220; H. Terrell Kays, 4321 N. 500 E., Danville, Ind. 46122

[21] Appl. No.: 541,339

[22] Filed: Jun. 21, 1990

[51] Int. Cl.[5] ..... B65D 1/36

[52] U.S. Cl. ..... 206/561; 206/562; 206/563; 206/565; 220/556; 229/904

[58] Field of Search ..... 220/556, 23.83; 206/557, 561, 203, 562, 563, 564, 565; 229/904

[56] References Cited

U.S. PATENT DOCUMENTS

| | | | |
|---|---|---|---|
| 3,103,303 | 9/1963 | Lynchey | 206/563 |
| 3,162.344 | 12/1964 | Sabol | 229/904 X |
| 3,941,286 | 3/1976 | Perkinson | 206/557 |
| 3,955,672 | 5/1976 | Brundage | 206/562 |
| 4,219,144 | 8/1980 | Hagelberg | 206/563 X |
| 4,461,396 | 7/1984 | Harper | 206/565 X |
| 4,516,685 | 5/1985 | French | 206/563 X |
| 4,607,758 | 8/1986 | Stevens | 206/563 X |
| 4,732,274 | 3/1988 | Bouton | 206/557 |

*Primary Examiner*—William I. Price
*Attorney, Agent, or Firm*—Robert A. Spray

[57] ABSTRACT

A snack tray providing easy one-hand carry by the provision of a special thumb-hole, by which the outer end of the user's thumb provides a support-stability of a fulcrum located generally centrally not only of the upward forces from the user's fingers and thumb-base but also generally centrally of the tray. Other features include a central indention for providing an automatic forcing of the user to place his thumb's outer end in a location so as to not slip into a portion of the snack items being carried, and also achieve its central fulcrum effect; and the forward and rearward walls of the thumb hole are slanted, providing a comfortable and guiding surface for the user's insertion of his thumb's outer end portion. Other special provisions add to the advantages.

6 Claims, 2 Drawing Sheets

CONVENIENCE TRAY

FIELD OF THE INVENTION

The present invention relates to convenience trays, sometimes called party trays or snack trays, which are provided as hand-held trays for guests at a party or other gathering at which the guests are expected to hold a tray of snacks, drinks, etc., while walking or when seated at a location other than at a table.

At social gatherings of that nature, it is often inconvenient, awkward, and otherwise disadvantageous, to try to gracefully manage the carrying of whatever plate or tray has been provided; and even though the tray is often not at all too heavy to be easily carried, even when carrying snacks and a drink, it is very difficult to hold such a tray with one hand so as to use the other hand free for whatever reason, such as to eat, shake hands with other guests, make hand gestures, etc.

Special trays have been developed; yet various features and concepts of the present invention provide advantages not achieved by prior devices.

BRIEF SUMMARY OF THE INVENTION

According to the present invention, a snack tray is provided with a thumb-hole feature; and in contrast to prior art trays, the present invention improves snack trays by various factors. That is, the present invention provides the concept of achieving better leverage by the concept of locating the thumb-hole so that the user will practically automatically locate his thumb in a centroidal portion of the tray for maximum ease of tray-support, with the outer end of the user's thumb automatically in a position serving as a fulcrum directly onto the tray, and with hardly any likelihood of poking his or her thumb into the food-portions being carried.

Other features of the present invention include the provision of shaping the thumb-hole so that maximum user-comfort is achieved.

Further, as specified more particularly below, the concepts provide for the almost spill-proof carrying of goblets by providing easily used edge-slits through which the goblet stem may pass. Other features include the provision of improved glass-support features below the tray, accommodating tall glasses in a well-supported manner, and permitting the tray to be placed stably down onto a table even though the glasses carried by the tray extend below the tray. Other details are noted below.

The prior art does not show the inventive concepts:

The prior art as to food-service trays is no doubt quite ancient, not only to shapes and sizes, but even includes trays small enough to be easily carried by only one hand. Trays are rather simple in nature, and such devices are quite of open or easily-observable nature, easily understood with no high degree of technical know-how or mechanical aptitude.

The prior art has long had much motivation as to apparatus of the present invention; and a consideration of such prior art, and a recollection of a food-carrier tray used by any reader, seems to emphasize the inventive nature of this invention.

Further, it is emphasized that the prior art has had several particulars of prior art ability and motivation which individually and accumulatively help show the non-obviousness of this combination invention as to its various features:

Forming and shaping procedures and know-how as to panel objects of metal and plastics; knowledge of especially-advantageous achievements by a combination of concepts; the desirability of making trays and tray-carried objects generally spill-proof and easily carried; etc.

With the reality of all these factors, the inventive non-obviousness of the present invention is seen to be quite manifest.

The prior art has had features of the present invention, and approaches to its concepts, but not in the combination by which the invention as a whole is advantageously achieved:

The background of prior art as just summarized seems more significant in showing the non-obviousness of the present concepts when also it is reminded that the prior art also had long provided and long used principles of combination articles, and combination concepts as to many types of devices, and the prior art long realized that combination was quite desirable in various devices, for a variety of uses; and manufacturing procedures are well known by which all components of the present invention could have been made, but only if the prior art had had the specific concepts of the invention.

And the existence of such articles embodying such various features is not only conceded, it is emphasized; for as to the novelty here of the combination, of the invention as considered as a whole, a contrast to the prior art helps show both the great variety of the various prior art attempts of improvement, and the advantages and the inventive significance of the present concepts. Thus, as shown herein as a contrast to all the prior art, the inventive significance of the present concepts as a combination is emphasized, and the nature of the concepts and their results can perhaps be easier understood.

Although varieties of prior art are conceded, and ample motivation is shown, and full capability in the prior art is conceded, no prior art shows or suggests details of the overall combinations of the present invention, as is the proper and accepted way of considering the inventiveness nature of the concepts.

That is, although the prior art shows an approach to the overall invention, of particularly many types and styles two-hand and one-hand devices, and the prior art has shown various natures of all such articles, it is significant that none of the prior art shows the novel and advantageous combination, which provides the merits of this invention, even though certain details are shown separately from this accomplishment.

Accordingly, the various concepts and components are conceded and emphasized to have been widely known in the prior art as to various devices; nevertheless, the prior art not having had the particular combination of concepts and details as here presented and shown in novel combination different from the prior art and its suggestions, even only a fair amount of realistic humility, to avoid consideration of this invention improperly by hindsight, requires the concepts and achievements here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art of all relevant fields.

The above description of the novel and advantageous invention is of somewhat introductory and generalized form. More particular details, concepts, and features are set forth in the following and more detailed description of the illustrative embodiments, reference being had to the accompanying generally diagrammatic and schematic drawings.

BRIEF DESCRIPTION OF THE DRAWINGS

FIG. 2 view also shows the one-hand carry by the user as mentioned above, with the center centroidal axis diagrammatically indicated by the indicator line "A";

DESCRIPTION OF ILLUSTRATIVE EMBODIMENTS

Figure 1:
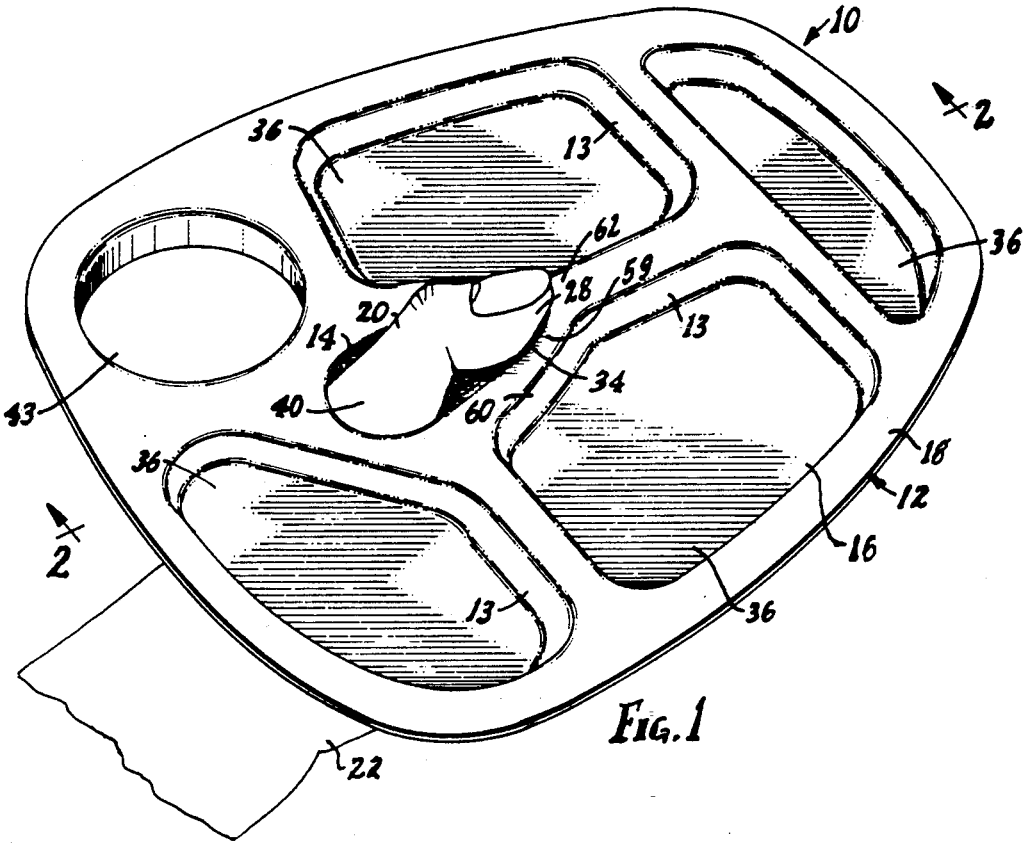
FIG. 1 is a pictorial view of a convenience tray of a first embodiment, with compartmentalization as to five areas of the tray, and with a bottomless opening for the carrying of a drinking cup or glass, ice cream cone, etc.; and the tray is shown with the user's thumb having been inserted upwardly through the tray, with the outer end of the user's thumb pressing downwardly on a central upper region of the tray.

In the embodiments of the invention shown in the drawings, different versions are shown as providing a hand-holdable tray, particularly useful for portions of snacks and/or liquids which a user would carry when walking about or when seated at a place not having a table or other surface conveniently nearby for stable support of the tray. All of the embodiments provide a tray with single-hand support nature; and thus brevity of description and convenience of understanding is achieved by use of similar reference numerals but with different suffix letters to similar components of the several embodiments.

In the embodiment of FIG. 1, there is shown a tray 10 comprising a panel or sheet body 12 having an overall area in the order of about one hundred square inches, for providing carry-about support for snacks and/or liquids, the sheet body 12 having sufficient depth to provide significant rigidity for carry-about use. That depth, and resulting rigidity or strength, giving the tray's sheet body 12 ample inertia from a beam-strength standpoint, is achieved by the vertical walls 13 which give a compartmentalization nature.

As probably its most noticeable feature, the sheet body 12 is provided with a hole 14 which extends fully from the lowermost portion or face 16 through the uppermost portion or face 18 of the sheet body 12 in the region of the hole 14, and the hole 14 is large enough to accommodate a thumb 20 of the user when supporting the tray 10 in the advantageous single-hand carry or support of the tray 10 as pictorially shown in all of FIGS. 1, 2, 3, and 4; for all the embodiments provide the easy one-hand tray carry by the feature of a thumb-hole 14.

Figure 2:
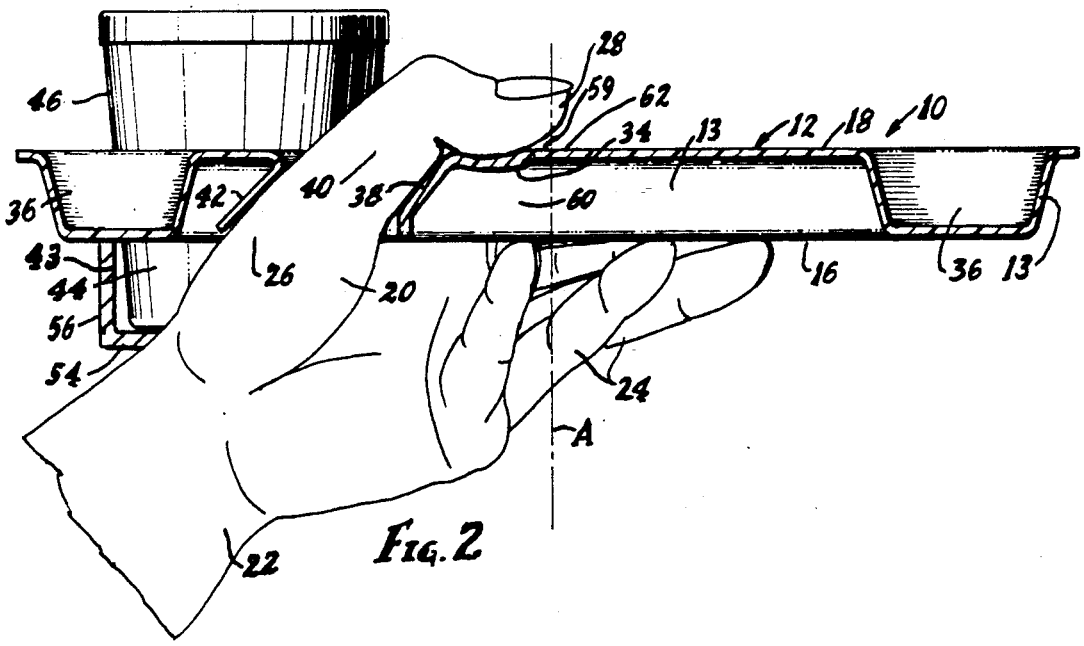
FIG. 2 is a vertical cross-sectional view of the tray shown in FIG. 1, except that the tray of FIG. 2 is provided with a supporting socket for the hole provided for the drinking vessel, and with a drinking vessel shown being carried in the socket.
Figure 3:
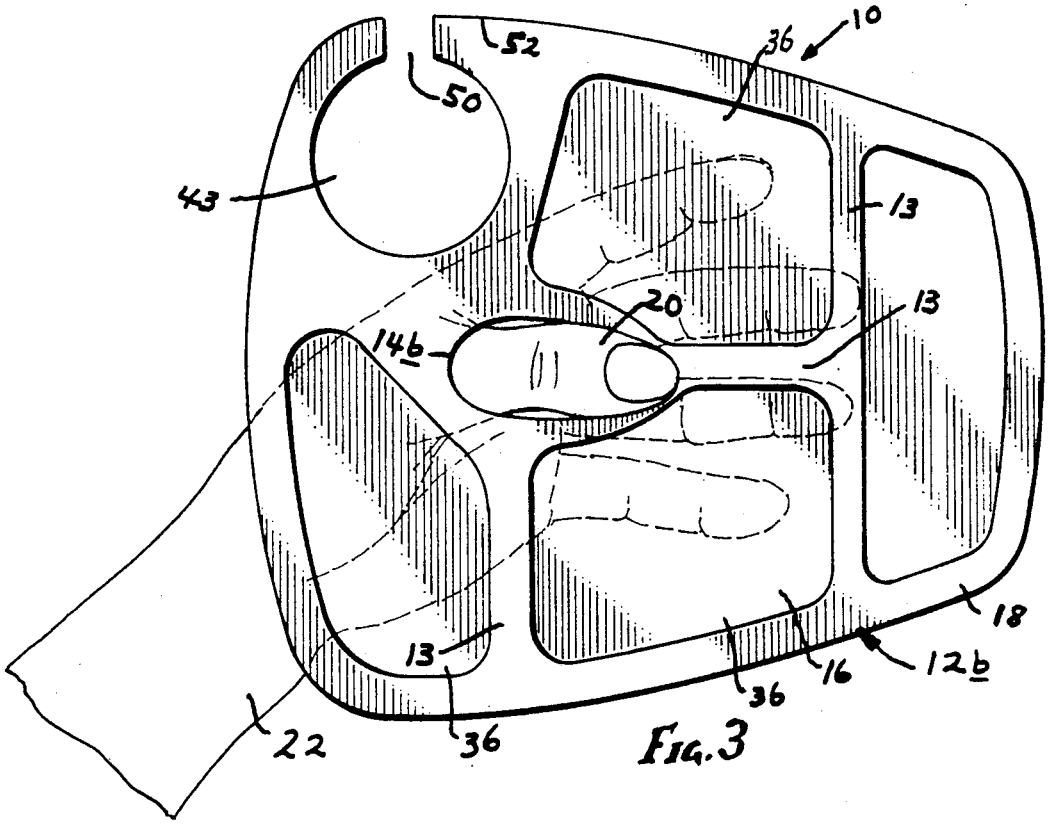
FIG. 3 is a top plan view of a tray generally according to the embodiments of FIGS. 1 and 2 except that the thumb hole is of a sort of an elliptical or oval shape; and in this FIG. 3 embodiment the opening for a drinking vessel is provided with an edge-slot for accepting the vertical central stem of a goblet.

That is, as best illustrated in FIGS. 2 and 3, with the user's hand 22 below the sheet body 12, with the user's fingers 24 and thumb base 26 pushing upwardly against the sheet body 12 and with the user's thumb 20 passing through the thumb-hole 14 and the outer end 28 of that thumb 20 pressing downwardly onto the sheet body 12, the forces involved (those upward forces of the thumb base 26 and fingers 24 and downward force of the thumb's outer end 28) provide in effect that the thumb-end 28 provides a supportive and downwardly-forcing fulcrum between those other forces (of 26 and 24).

The advantages of the present invention do not come merely from a thumb-hole carry but particularly from details and cooperative features as shown in the various Figures of the drawings.

Figure 5:
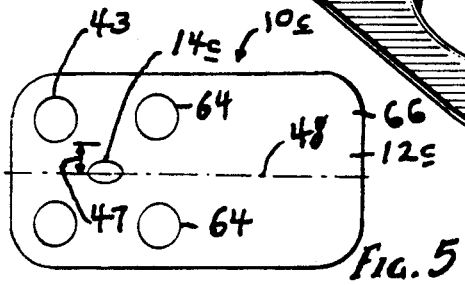
FIG. 5 is a diagrammatic view, on much smaller scale than any of FIGS. 1–4, illustrating another embodiment providing that the vessel-locations are generally at one end of the tray, and with the oval or elliptical thumb hole generally centered with respect to those four vessel-locators, thereby providing that the support of the tray, during a one-hand procedure of carrying the tray, will be generally centered with respect to the location of the heavier items (the vessels) being carried.

As a significant one of such details and features, and a characteristic of all the embodiments except that of FIG. 5, it is to be noted that the hole 14 is provided at a location of the sheet body 12 such that the outer end 28 of the user's thumb 20 will be in a generally central location on the sheet body 12; and this provides that the user's thumb end 28 will provide the fulcrum-effect in a central portion of the sheet body 12.

Figure 4:
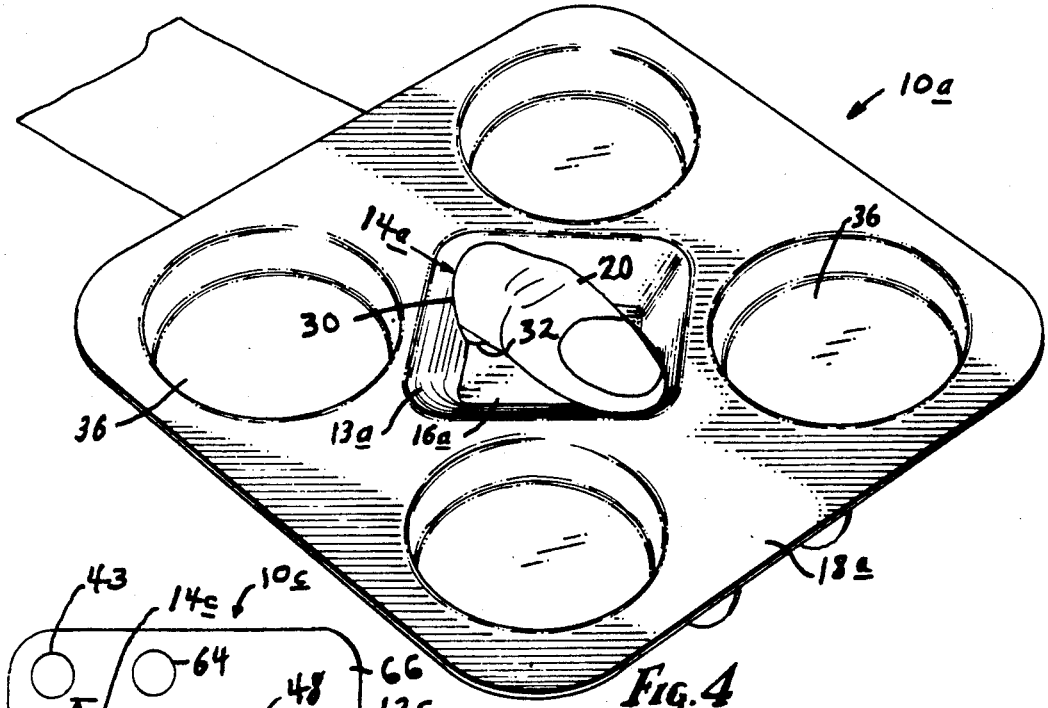
FIG. 4 is a pictorial view of a convenience tray of another embodiment, this one having a four socket-like openings for the carrying of drinking vessels, and a central recess, the thumb hole in this embodiment being provided by adjacent portions of a bottom panel of that recess and of the downward supporting wall which extends between the tray surface and the bottom panel of the recess, the view also showing the one-hand carry of the tray by the user who has pushed his thumb upwardly through the thumb hole and with the user's fingers and thumb base pushing upwardly on the tray.

The present concepts are particularly useful in modifications of trays **10*a* of pressed cardboard or the like which are not intended for single-hand carry, for they have no thumb-hole, although they do have a lower sheet-like panel 16*a* in a centroidal location (FIG. 4). Such trays 10*a* have a support wall 13*a* supportively extending between that sheet-like bottom panel 16*a* and upper panel portions 18*a* of the sheet body 12*a*. Thus, for such a tray 10*a*, as modified by the present concepts, hole 14*a* is provided for the user's thumb 20 by providing an opening 30 and 32 in contiguous portions of the support wall 13*a* and the sheet-like bottom panel 16*a***, respectively.

Again referring to FIGS. 1 and 2 for an illustrative showing, desirably the top surface 18 of the sheet body 12 is provided with a indention 34 in the central portion of the sheet body 12 for providing an effectively automatic forcing of the user to place his thumb's outer end 28 in a location in which the thumb-end 28 will likely to not slip into or be positioned inadvertently in a portion of the snack items being carried in an adjacent one of the snack-item compartments 36 delineated by the vertical walls 13; and the indention 34 also assures that the user's thumb-end 28 will be properly positioned to achieve its fulcrum effect in a generally central position of the sheet body 12.

A feature best shown in FIG. 2 is that the panel or sheet of the forward portion 38 of the hole 14 for user's thumb 20 is slanted upwardly and forwardly, providing a comfortable surface for the user's thumb-portion 40 inwardly of its outer end portion 28; and, similarly, the panel or sheet of the rearward portion 42 of the hole for the user's thumb 20 is slanted upwardly and forwardly, providing a comfortable surface for the user's thumb-base 26 for its upwardly-directed support force.

The thumb-hole 14 is generally of the shape of a slanting cylinder, which is difficult to see in the views shown as FIGS. 1 and 2, but is easiest seen to be such in plan view, FIG. 3, where the thumb-hole **14*b* shows as oval or elliptical in its intersection with the upper panel surface 18, thus having a generally slanting cylindrical shape, thus in effect serving to guide the user's thumb-end 28 longitudinally of the sheet 12 and onto the top wall portion 18 and its indention 34 (FIGS. 1, 2**).

The sheet body 12 is shown (FIGS. 1, 3, and 5) as provided with a receiver hole 43 through which may be passed the lower portion 44 of a vessel 46 whose lower portion is smaller in diameter than the receiver hole 43; and as illustrated in FIG. 5, the receiver hole 43 is spaced (47) transversely of the sheet body **12*c* sufficiently to provide that the receiver hole 43 is more than about one inch transversely from the fore-and-aft axis 48 of the sheet body 12 through the thumb-hole 14*c*. Thus, even if the receiver hole 43 is carrying a vessel, the adjacent portion of the user's hand is accommodated even though the user's thumb is in tray-carrying position extending through the thumb-hole 14*c***.

The hole 43 may also carry an item such as an ice cream cone, of upwardly increasing size.

Providing for easy and careful carry of a wine goblet (see FIG. 3), the sheet body **12*b* is provided with an access opening 50 extending inwardly from an edge 52 of the sheet body 12*b*. Thus, as with a wine goblet, in which the associated vessel has a portion larger than a stem portion, the access opening 50 being larger than the stem but smaller than the vessel's or cone's larger portion, the vessel or cone may be placed in a position supported by the sheet body 12*b* by insertion of the stem, lower cone-portion, etc., inwardly through the access opening 50**.

In addition to the thumb-holes 14, the inventive concepts provide that in an embodiment which the sheet body 12 is provided with other holes 43 for receiving vessels 46 whose bases 44 are to be below the sheet body 12, there are provided (FIG. 2) a support panel 54 for each of such other holes 43 for supporting vessels 46 in that relatively lower position with respect to the sheet body 12, and there are also provided support walls 56 supportingly interconnecting the sheet body 12 and those support panels 54; and those other holes 43, panel means 54, and support walls 56 means are of a sufficient plurality and placement with respect to the sheet body 12 as to permit the user to place the tray 10 onto a support surface and be stable thereon by resting stably on at least three of such support panels 54, even though the tray be then carrying vessels (or cones, etc.) whose bases 44 are below the sheet body 12.

With further reference to a portion 59 of the tray 10 in the region of the indention 34, and as best shown in FIGS. 1–3, the compartmentalization of the sheet body 12 includes a recess 36 on both sides of the location of the outer end 28 of the user's thumb positioned as specified above after being pushed upwardly through the hole 14, and a dividing rib 60 between the two recesses 36; and this provides the plural functions of a divider as to food items carried respectively in the recesses 36, a stiffener for the sheet body 12, and a tray portion 62 above the food items carried respectively in the recesses 36.

FIG. 5 illustrates an embodiment in which the thumb-hole **14*c* is not centrally of the tray body 12*c*, but instead is purposely displaced from the center of the sheet body 12*c*. In this FIG. 5 embodiment, which is to provide a tray 10*c* for carrying some snack items but also a plurality of liquid items, the tray 10*c* has a plurality of designating means 64 for designating the location of vessels for holding a liquid or liquids, and the location of the hole 14*c* for the user's thumb is provided to be generally centrally of those designating means 64, whether or not generally centrally of the sheet body 12*c*; and those designating means 64 are physical, e.g., as either a circular ridge or a hole, the physical nature of which tends to force the user to position the liquid items in the close proximity to the thumb-hole 14*c* so as to minimize the difficulty of the cantilever beam effect of the liquid items which would likely be significantly heavier than the snack food items which could easily be supported on the other tray area 66 in spite of the cantilever beam effect, of their weight being carried at a relatively long distance from the support being at and around the thumb-hole 14*c***.

OPERATIVITY SUMMARY

The concepts co-operate to provide a tray device whose centroidal thumb-hole and other co-operating concepts make it advantageously convenient to use, even by a person who might be somewhat clumsy or at least untrained in object-carrying tasks, and even by a person who, such as at a party or other high-attendance social gathering, is desirably concentrating on the social and socializing happenings in contrast to balancing a tray and avoiding the embarrassment of spillage.

CONCLUSION

It is thus seen that a one-hand thumb-forced and centroidally-fulcrummed device, as provided and used according to the inventive concepts herein set forth, provides novel concepts of a desirable and advantageous device, yielding the advantages of a snack tray, having advantageous details and features of carry and balance, which, in overall combination, is conceptually different from the prior art articles even though various objects embodying or approaching certain of the mechanical details as a basic capability have, of course, been known for years; yet significantly this particular combination, even considered as including or building on prior art concepts, and even considering other one-hand trays, has not been suggested by the prior art, this achievement being a substantial and advantageous departure from prior art, all this even though the prior art shows attempts at improvement and variations as to tray devices for many years. And particularly is the overall difference from the prior art significant when the non-obviousness is viewed by a consideration of the subject matter as a whole, as integrally incorporating a combination of features as different from or building on the prior art, in contrast to merely those details of novelty themselves, and further in view of the prior art teaching away from the particular and inter-related concepts and features of the present invention.

In summary as to the nature of these advantageous concepts, their inventiveness is shown by novel features of concept and construction shown here, in novel and advantageous combination, not only being different from all the prior art known, but because the achievement is not what is or has been suggested to those of ordinary skill in the art, especially realistically considering this as comprising components which individually are similar in nature to what is well known in the arts of manufacture and use of food-carrier trays for many years. No prior art has suggested the modifications of any prior art to achieve the novel concepts here achieved, with the various features providing their own functions in the overall combination; and this is particularly significant since these devices are objects whose mechanisms are easy and apparent to observe, and are not technically sophisticated as to either construction, use, or operative principles.

Accordingly, it will thus be seen from the foregoing description of the invention according to these illustrative embodiments, considered with the accompanying drawings, that the present invention provides new and useful concepts of a novel and advantageous snack tray with particular features which singly and in combination yield desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiments, or form or arrangement of parts herein described or shown.

We claim:

1. A hand-holdable tray, particularly for snacks and/or liquids and/or cones, and/or other foodstuffs, for the user's partaking thereof when walking about or when seated at a place not having a table or other surface conveniently nearby for stable support of the tray;

the tray comprising a tray body having an area for providing support for snacks and/or liquids and/or cones and/or other foodstuffs, and the tray body having sufficient depth to provide significant rigidity for such a use;

and the tray body is provided with a hole extending fully from the lowermost through the upper portion of the tray body in the region of the hole;

the hole being large enough to accommodate a thumb of the user in a procedure of holding the tray body with the user's hand below the tray body, with the user's finger(s) and thumb base pushing upwardly against the tray body, and with the user's thumb passing through the hole, and the outer end of that thumb pressing downwardly onto the tray body and providing in effect a supportive and downwardly-forcing fulcrum between the upward forces of the user's finger(s) and thumb base;

the hole being provided at a location of the tray body such that the outer end of the user's thumb will be in a generally central location on the tray body, and thereby the user's thumb end will provide the said fulcrum effect in a central portion of the tray body even in an item-carrying procedure in which there is not a glass-base or other associated item carried in a position such that the glass-base or other associated item rather than the user's thumb-end is achieving the fulcrum effect in the central portion of the tray body;

in a combination in which the tray body is provided with a receiver hole through which may be passed the lower portion of a carried object whose lower portion is smaller in diameter than said receiver hole; and in which the receiver hole is spaced transversely of the fore-and-aft axis of the tray body through the thumb hole sufficiently to provide, even if the receiver hole is carrying an object which extends through the hole, that the said receiver hole accommodates the adjacent portion of the user's hand even though the user's thumb is in tray-carrying position extending through the thumb hole as aforesaid.

2. A hand-holdable tray, particularly for snacks and/or liquids and/or cones, and/or other foodstuffs, for the user's partaking thereof when walking about or when seated at a place not having a table or other surface conveniently nearby for stable support of the tray;

the tray comprising a tray body having an area for providing support for snacks and/or liquids and/or cones and/or other foodstuffs, and the tray body having sufficient depth to provide significant rigidity for such a use;

and the tray body is provided with a hole extending fully from the lowermost through the upper portion of the tray body in the region of the hole;

the hole being large enough to accommodate a thumb of the user in a procedure of holding the tray body with the user's hand below the tray body, with the user's finger(s) and thumb base pushing upwardly against the tray body, and with the user's thumb passing through the hole, and the outer end of that thumb pressing downwardly onto the tray body and providing in effect a supportive and downwardly-forcing fulcrum between the upward forces of the user's finger(s) and thumb base;

the hole being provided at a location of the tray body such that the outer end of the user's thumb will be in a generally central location on the tray body, and thereby the user's thumb end will provide the said fulcrum effect in a central portion of the tray body even in an item-carrying procedure in which there is not a glass-base or other associated item carried in a position such that the glass-base or other associated item rather than the user's thumb-end is achieving the fulcrum effect in the central portion of the tray body;

in which the top surface of the tray body is provided with an indention in the central portion of the tray body for providing an effectively automatic forcing of the user to place the thumb's outer end in a location in which the thumb-end will likely to not slip into nor be positioned inadvertently in a portion of the snack items being carried, and also the thumb-end will be properly positioned to achieve its fulcrum effect in a generally central position of the tray body;

in a combination in which the tray body includes a recess on both sides of the location of the outer end of the user's thumb positioned as specified, and with a dividing rib between the two recesses providing the plural functions of a divider as to food items carried respectively in the recesses, a stiffener for the tray body, and a tray portion above the food items carried respectively in the recesses, upon which tray portion is provided the said indention.

3. A hand-holdable tray, particularly for snacks and/or liquids and/or cones, and/or other foodstuffs, for the user's partaking thereof when walking about or when seated at a place not having table or other surface conveniently nearby for stable support of the tray;

the tray comprising a tray body having an area for providing support for snacks and/or liquids and/or cones and/or other foodstuffs, and the tray body having sufficient depth to provide significant rigidity for such a use;

and the tray body is provided with a hole extending fully from the lowermost through the upper portion of the tray body in the region of the hole;

the hole being large enough to accommodate a thumb of the user in a procedure of holding the tray body, with the user's hand below the tray body, with the user's finger(s) and thumb base pushing upwardly against the tray body, and with the user's thumb passing through the hole, and the outer end of that thumb pressing downwardly onto the tray body and providing in effect a supportive and downwardly-forcing fulcrum between the upward forces of the user's finger(s) and thumb base;

the hole being provided at a location of the tray body such that the outer end of the user's thumb will be in a generally central location on the tray body, and thereby the user's thumb end will provide the said fulcrum effect in a central portion of the tray body even in an item-carrying procedure in which there is not a glass-base or other associated item carried in a position such that the glass-base or other associated item rather than the user's thumb-end is achieving the fulcrum effect in the central portion of the tray body;

in a combination in which the tray body is provided with a receiver hole into which may be passed the lower portion of a carried object whose lower portion is smaller in diameter than said receiver hole; and in which the receiver hole is spaced transversely of the fore-and-aft axis of the tray body through the thumb hole sufficiently to provide, even if the receiver hole is carrying an object which extends into the hole, that the said receiver hole accommodates the adjacent portion of the user's hand even though the user's thumb is in tray-carrying position extending into the thumb hole as aforesaid.

4. A hand-holdable tray, particularly for snacks and/or liquids and/or cones, and/or other foodstuffs, for the user's partaking thereof when walking about or when seated at a place not having table or other surface conveniently nearby for stable support of the tray;

the tray comprising a tray body having an area for providing support for snacks and/or liquids and/or cones and/or other foodstuffs, and the tray body having sufficient depth to provide significant rigidity for such a use;

and the tray body is provided with a hole extending fully from the lowermost through the upper portion of the tray body in the region of the hole;

the hole being large enough to accommodate a thumb of the user in a procedure of holding the tray body, with the user's hand below the tray body, with the user's finger(s) and thumb base pushing upwardly against the tray body, and with the user's thumb passing through the hole, and the outer end of that thumb pressing downwardly onto the tray body and providing in effect a supportive and downwardly-forcing fulcrum between the upward forces of the user's finger(s) and thumb base;

the hole being provided at a location of the tray body such that the outer end of the user's thumb will be in a generally central location on the tray body, and thereby the user's thumb end will provide the said fulcrum effect in a central portion of the tray body even in an item-carrying procedure in which there is not a glass-base or other associated item carried in a position such that the glass-base or other associated item rather than the user's thumb-end is achieving the fulcrum effect in the central portion of the tray body;

in a combination in which the tray body is provided with wall means which provide(s) the hole into which may be passed the lower portion of a carried object whose lower portion is smaller in diameter than said receiver hole; and in which the wall means which provide(s) the receiver hole is/are spaced transversely of the fore-and-aft axis of the tray body through the thumb hole sufficiently to provide, even if the receiver hole is carrying an object which extends into the hole, that the said receiver hole accommodates the adjacent portion of the user's hand even though the user's thumb is in tray-carrying position extending through the thumb hole as aforesaid.

5. A tray according to claim 4, in which the wall means which provide(s) the receiver hole is/are open at the bottom, providing that the carried object may be of such a length that it extends fully through said open hole bottom.

6. A hand-holdable tray, particularly for snacks and/or liquids and/or cones, and/or other foodstuffs, for the user's partaking thereof when walking about or when seated at a place not having a table or other surface conveniently nearby for stable support of the tray;

the tray comprising a tray body having an area for providing support for snacks and/or liquids and/or cones, and/or other foodstuffs, and the tray body having sufficient depth to provide significant rigidity for such a use;

and the tray body is provided with a hole extending fully from the lowermost through the upper portion of the tray body in the region of the hole;

the hole being large enough to accommodate a thumb of the user in a procedure of holding the tray body with the user's hand below the tray body, with the user's finger(s) and thumb base pushing upwardly against the tray body, and with the user's thumb passing through the hole, and the outer end of that thumb pressing downwardly onto the tray body and providing in effect a supportive and downwardly-forcing fulcrum between the upward forces of the user's finger(s) and thumb base;

in a combination in which the hole is provided at a location of the tray body such that the outer end of the user's thumb will be in a generally central location on the tray body, with respect to both the laterial and fore-and-aft directions of the tray body, and the tray body having recesses extending downwardly from the tray body, and with wall means providing the portion of the recesses below the tray body and outwardly from both sides of the hole for the user's thumb, but the wall means being spaced therefrom on both lateral sides therefrom, arranged so as to provide that either of a person's hands could be used to provide the thumb which is used with the tray can be either a right hand or a left hand, without obstruction of the user's hand which is providing the thumb which holds the tray.

* * * * *

US005152398A

REEXAMINATION CERTIFICATE (2277th)

United States Patent [19]

[11] B1 5,152,398

Forestal et al.

[45] Certificate Issued Apr. 19, 1994

[54] CONVENIENCE TRAY

[76] Inventors: Robert J. Forestal, 2714 Coldstream La., Indianapolis, Ind. 46220; H. Terrell Kays, 4321 N. 500 E., Danville, Ind. 46122

Reexamination Request:
No. 90/002,897, Nov. 30, 1992

Reexamination Certificate for:

| | |
|---|---|
| Patent No.: | **5,152,398** |
| Issued: | **Oct. 6, 1992** |
| Appl. No.: | **541,339** |
| Filed: | **Jun. 21, 1990** |

[51] Int. Cl.[5] ..... B65D 1/36

[52] U.S. Cl. ..... 206/561; 206/562; 206/563; 206/565; 220/556; 220/904

[58] Field of Search ..... 206/561-565, 206/203; 229/904; 220/23.83, 556; D7/543-554

[56] References Cited

U.S. PATENT DOCUMENTS

| | | | |
|---|---|---|---|
| D. 87,682 | 8/1932 | Porter . | |
| D. 145,764 | 10/1946 | Zelov . | |
| D. 147,543 | 9/1947 | Farmer . | |
| D. 162,860 | 4/1951 | Mercer | D44/15 |
| D. 174,479 | 4/1955 | Bosch . | |
| D. 182,396 | 4/1958 | Berry | D44/10 |
| D. 186,901 | 12/1959 | Hansen . | |
| D. 201,696 | 7/1965 | Zorn . | |
| D. 290,919 | 7/1987 | Beute | D7/38 |
| D. 296,404 | 6/1988 | Lowenbein | D7/38 |
| D. 305,192 | 12/1989 | Van Erkel | D7/1 |
| D. 326,799 | 6/1992 | Vanderzell | D7/549 |
| 1,953,933 | 4/1934 | Gundelach . | |
| 2,295,860 | 9/1942 | Oliver . | |
| 3,498,470 | 3/1970 | Thomas | 211/74 |
| 4,732,274 | 3/1988 | Bouton | 206/561 |
| 4,867,331 | 9/1989 | Task | 220/23.8 |
| 4,991,713 | 2/1991 | Phillips | 206/218 |

FOREIGN PATENT DOCUMENTS

| | | |
|---|---|---|
| 255643 | 7/1926 | United Kingdom . |
| 266528 | 3/1927 | United Kingdom . |
| 553089 | 5/1943 | United Kingdom . |
| 1126304 | 9/1968 | United Kingdom . |

*Primary Examiner*—William I. Price

[57] ABSTRACT

A snack tray providing easy one-hand carry by the provision of a special thumb-hole, by which the outer end of the user's thumb provides a support-stability of a fulcrum located generally centrally not only of the upward forces from the user's fingers and thumb-base but also generally centrally of the tray. Other features include a central indention for providing an automatic forcing of the user to place his thumb's outer end in a location so as to not slip into a portion of the snack items being carried, and also achieve its central fulcrum effect; and the forward and rearward walls of the thumb hole are slanted, providing a comfortable and guiding surface for the user's insertion of his thumb's outer end portion. Other special provisions add to the advantages.

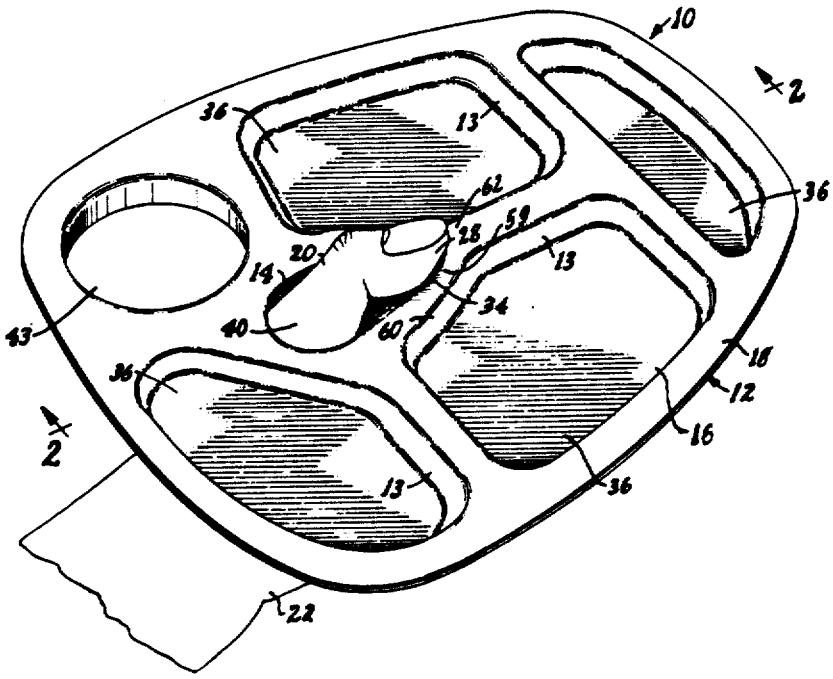

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-6 is confirmed.

New claims 7-17 are added and determined to be patentable.

*7. A tray according to patent claim 1, in a combination in which the tray body of the forward portion of the hole for the user's thumb is provided to be of cylinder form, slanted upwardly and forwardly, thus providing a comfortable surface for the user's thumb-portion inwardly of its outer end portion, as the user presses downwardly on the tray body with his thumb.*

*8. A tray according to patent claim 1, in a combination in which the tray body of the rearward portion of the hole for the user's thumb is provided to be of cylinder form, slanted upwardly and forwardly, thus providing a comfortable surface for the user's thumb-base, as the user presses upwardly on the tray body with his thumb-base.*

*9. A tray according to patent claim 2, in a combination in which the tray body of the forward portion of the hole for the user's thumb is provided to be of cylinder form, slanted upwardly and forwardly, thus providing a comfortable surface for the user's thumb-portion inwardly of its outer end portion, as the user presses downwardly on the tray body with his thumb.*

*10. A tray according to patent claim 2, in a combination in which the tray body of the rearward portion of the hole for the user's thumb is provided to be of cylinder form, slanted upwardly and forwardly, thus providing a comfortable surface for the user's thumb-base, as the user presses upwardly on the tray body with his thumb-base.*

*11. A tray according to patent claim 3, in a combination in which the tray body of the forward portion of the hole for the user's thumb is provided to be of cylinder form, slanted upwardly and forwardly, thus providing a comfortable surface for the user's thumb-portion inwardly of its outer end portion, as the user presses downwardly on the tray body with his thumb.*

*12. A tray according to patent claim 3, in a combination in which the tray body of the rearward portion of the hole for the user's thumb is provided to be of cylinder form, slanted upwardly and forwardly, thus providing a comfortable surface for the user's thumb-base, as the user presses upwardly on the tray body with his thumb-base.*

*13. A tray according to patent claim 4, in a combination in which the tray body of the forward portion of the hole for the user's thumb is provided to be of cylinder form, slanted upwardly and forwardly, thus providing a comfortable surface for the user's thumb-portion inwardly of its outer end portion, as the user presses downwardly on the tray body with his thumb.*

*14. A tray according to patent claim 4, in a combination in which the tray body of the rearward portion of the hole for the user's thumb is provided to be of cylinder form, slanted upwardly and forwardly, thus providing a comfortable surface for the user's thumb-base, as the user presses upwardly on the tray body with his thumb-base.*

*15. A tray according to patent claim 5, in a combination in which the tray body of the forward portion of the hole for the user's thumb is provided to be of cylinder form, slanted upwardly and forwardly, thus providing a comfortable surface for the user's thumb-portion inwardly of its outer end portion, as the user presses downwardly on the tray body with his thumb.*

*16. A tray according to patent claim 6, in a combination in which the tray body of the forward portion of the hole for the user's thumb is provided to be of cylinder form, slanted upwardly and forwardly, thus providing a comfortable surface for the user's thumb-portion inwardly of its outer end portion, as the user presses downwardly on the tray body with his thumb.*

*17. A tray according to patent claim 6, in a combination in which the tray body of the rearward portion of the hole for the user's thumb is provided to be of cylinder form, slanted upwardly and forwardly, thus providing a comfortable surface for the user's thumb-base, as the user presses upwardly on the tray body with his thumb-base.*

* * * * *